US005846113A

United States Patent [19]

Nielsen et al.

[11] Patent Number: 5,846,113

[45] **Date of Patent: *Dec. 8, 1998**

[54] TOY BUILDING ELEMENT AND A TOY BUILDING SET COMPRISING TOY BUILDING ELEMENTS

[75] Inventors: Helle Kleist Nielsen, Frederiksberg; Paul Leadbetter, Holbæk, both of Denmark

[73] Assignee: INTERLEGO AG, Baar, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 714,857

[22] Filed: Sep. 17, 1996

[51] Int. Cl.[6] ..... A63H 33/04

[52] U.S. Cl. ..... 446/85

[58] Field of Search ..... 446/85, 102, 107, 446/119, 120, 121, 128

[56] References Cited

U.S. PATENT DOCUMENTS 3,242,610 3/1966 Christiansen .

5,312,283 5/1994 Lyman ..... 446/107 X

FOREIGN PATENT DOCUMENTS

WO 96/09869 4/1996 WIPO .

*Primary Examiner*—William H. Grieb

*Attorney, Agent, or Firm*—Kane,Dalsimer,Sullivan, Kurucz, Levy, Eisele and Richard, LLP

[57] ABSTRACT

The invention relates to a toy building element (1,8) for use in a toy building element system comprising a number of toy building elements with coupling studs for coupling with other toy building elements with complementary coupling sockets, the coupling studs being arranged in a regular pattern with a specific modular distance relative to each other. The toy building element is characterized in that in its free state at least some of the coupling studs of the toy building element are shifted relative to the modular distance, the mutual position of the coupling studs of the toy building element being elastically changeable at least to a mutual position corresponding to the modular distance.

The invention also relates to a toy building set having such a toy building element.

11 Claims, 1 Drawing Sheet

TOY BUILDING ELEMENT AND A TOY BUILDING SET COMPRISING TOY BUILDING ELEMENTS

Figure 1:
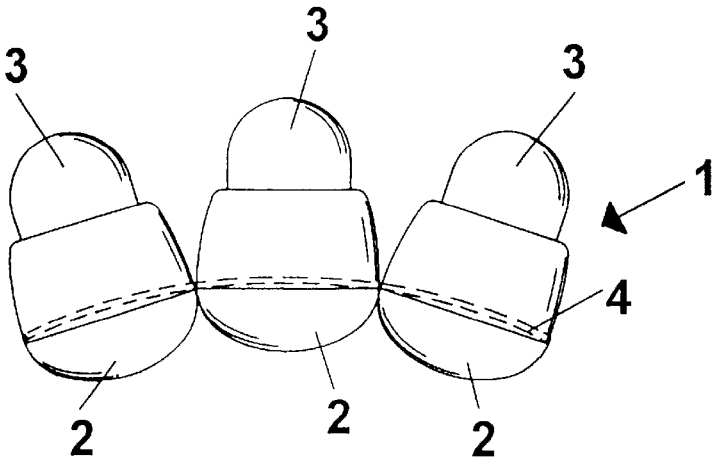

The present invention relates to a toy building element for use in a toy building element system comprising a number of toy building elements with coupling means for coupling with other toy building elements with complementary coupling means, said coupling means being arranged in a regular pattern with a specific modular distance relative to each other.

Many different types of such toy building elements are known which have many different coupling means, the most well known type being toy building elements with coupling studs.

Within this group of toy building elements, different embodiments are also known with e.g. round or square coupling studs disposed on the upper surface of the toy building elements and with complementary sockets on the underside of the toy building elements.

Toy building elements of this type may also be constituent parts of various toy building sets having different modular distances, where some of these toy building sets are more or less compatible.

Toy building sets of the above-mentioned type are known where the constituent toy building elements couple tightly with each other thereby allowing the construction of large structures which do not easily fall apart. However, toy building sets are also known where the toy building elements couple only very loosely with each other—the so-called stacking sets—where simple stacking of the toy building elements constitutes the only method of building structures.

In order to increase the number of building options available with toy building elements that couple loosely with each other, there is a need to develop a toy building element wherein the coupling force between this toy building element and the remaining toy building elements is increased while retaining the capacity of the toy building element for being used with the loose coupling, i.e. without the design of the coupling means proper being changed.

This object is achieved by constructing the toy building element mentioned in the introductory part in such a manner that at least some of the coupling means of the toy building element in the free state thereof are shifted relative to said modular distance, the mutual position of the coupling means of the toy building elements being elastically changeable at least to a mutual position corresponding to said modular distance.

Hereby a toy building element is provided which may couple tightly with other toy building elements if coupling is effected over several coupling means which are shifted relative to each other and relative to the modular distance. If, on the other hand, coupling is effected over only one or over more coupling means which are not shifted relative to each other and relative to the modular distance, it is still possible to provide a loose coupling between the toy building elements.

According to a preferred embodiment of the invention, the toy building element comprises at least two constituents, each of which is provided with coupling means and which are connected to each other in a flexible manner. In this way a comparatively simple toy building element is obtained which may consist of die-cast constituents that are connected to each other in a flexible manner.

The nature of the connection between the individual constituents may differ widely, as it may consist of a flexible rod extending through the constituents and preshaped to an arcuate configuration to ensure that the coupling means depart from the specific modular distance.

Alternatively the connection between the individual constituents may consist of a bellows portion or it may be provided by manufacturing the constituents in one piece with reduced material thickness between the constituents.

Preferably, the coupling means consist of coupling studs arranged on the upper surface of the toy building element, and according to a preferred embodiment there is exactly one coupling stud on each constituent. Preferably, coupling means are also provided on the underside of the toy building element in the form of sockets which are complementary to the coupling studs on the upper surface.

The invention also relates to a toy building set comprising a number of rigid toy building elements with coupling means for coupling with other rigid toy building elements with corresponding coupling means, said coupling means being arranged in a regular pattern with a specific modular distance relative to each other.

Such toy building sets are well known both in the form of building systems with a tight coupling between the toy building elements and as a stacking system with a loose coupling between the toy building elements.

In order to increase the number of building options available, in particular in connection with the stacking systems, there is a need for a novel toy building set wherein a tight as well as a loose coupling between the toy building elements may be effected.

This is obtained by composing the toy building set in such a manner that, in addition to the rigid toy building elements, it also comprises at least one flexible toy building element with coupling means, wherein at least some of the coupling means in the free state of the flexible toy building element are shifted relative to said modular distance, the mutual position of the coupling means of the flexible toy building element being elastically changeable at least to a mutual position corresponding to said modular distance.

Hereby a toy building set is provided wherein it is possible to interconnect the toy building elements with a loose as well as a tight coupling, the tight coupling being obtained when a rigid toy building element is connected with a flexible toy building element whereby the shifted coupling means of the flexible toy building element are forced to assume the modular distance, and due to the elasticity of the element provides a coupling force between the two building elements.

In particular, the toy building set is intended for a stacking set to provide the option of alternating between loose and tight couplings, but of course there is nothing to prevent the invention from being used in connection with a toy building set where the couplings between the toy building elements are already tight.

Preferably the coupling means on the rigid toy building elements consist of coupling studs arranged on the upper surface of the toy building elements and complementary sockets on the underside of the toy building elements, and the coupling means on the flexible toy building element consist at least of coupling studs on the upper surface of the flexible toy building element.

Figure 2:
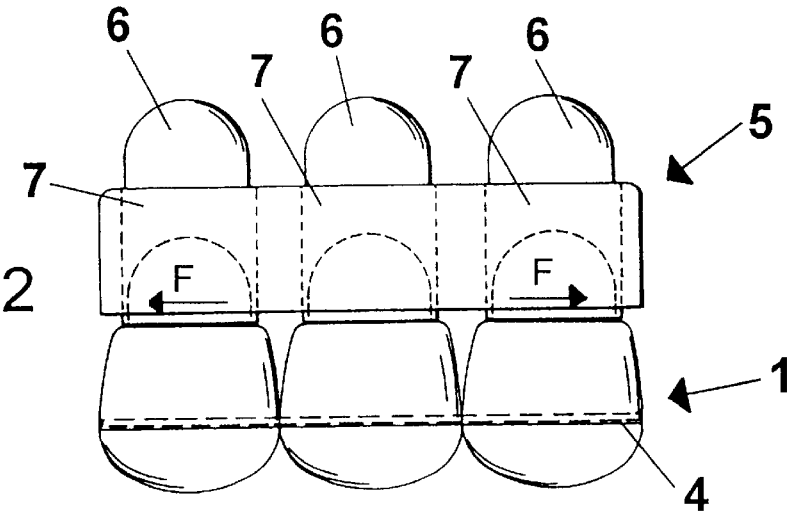
Figure 3:
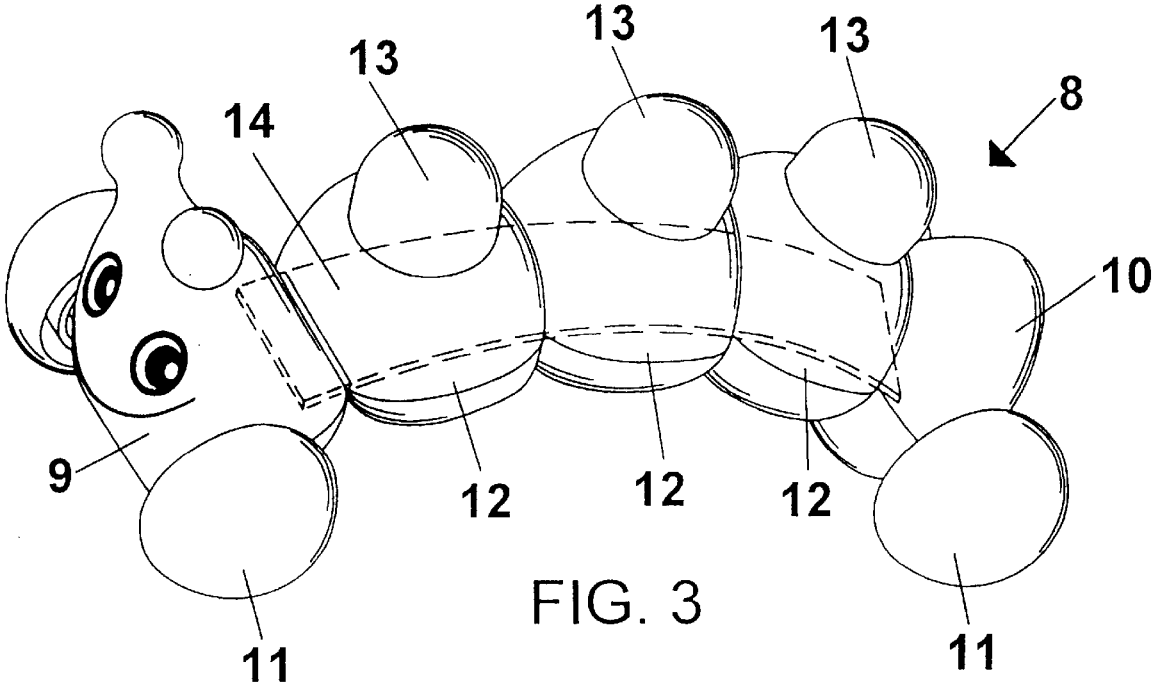

The invention will now be explained in further detail with reference to the drawings, wherein FIG. 1 illustrates a first embodiment of a toy building element according to the invention, FIG. 2 also illustrates the toy building element shown in FIG. 1, however with a rigid toy building element coupled thereto, and FIG. 3 illustrates an alternative embodiment of a toy building element according to the invention.

In FIG. 1 a first embodiment of a toy building element 1 according to the invention is illustrated.

The toy building element 1 consists of three constituents 2 that are each provided with a coupling stud 3 which allows the toy building element 1 to be connected to other toy building elements with complementary coupling means as will appear from FIG. 2 which will be described in further detail below.

Preferably the coupling studs 3 have a circular cross section with a rounded top, and preferably the toy building element 1 forms part of a stacking system with a loose coupling between the toy building elements, i.e. without any coupling force between the interconnected toy building elements.

The constituents 2 with coupling studs 3 are preferably made of a die-cast plastics material but, of course, it is possible to use other materials.

The constituents 3 are connected to each other around their centre portion by a through-going elastic band 4 shown with dashed lines seen from its most narrow side. This through-going band 4 is fastened to the end-constituents 2 and is preshaped to an arcuate configuration whereby the toy building element 1 is caused to assume the shape shown in FIG. 1 when it is in its free state, i.e. when it is not interconnected with other toy building elements.

Owing to the arcuate configuration of the through-going band 4, the coupling studs 3 have departed from the modular distance to be assumed by the toy building element in order for it to be able to couple with other toy building elements over more studs.

The through-going band 4 is of an elastic nature, whereby the toy building element 1 may be straightened to a straight configuration upon interconnecting with other toy building elements whereby the coupling studs 3 are caused to reassume the aforementioned modular distance.

This will appear from FIG. 2, where the toy building element 1 shown in FIG. 1 is interconnected with a rigid toy building element 5.

Like the toy building element 1, the upper surface of the rigid toy building element 5 is provided with three coupling studs 6 and, moreover, its underside is provided with complementary coupling means in the form of three downwardly extending tubular members 7, the internal diameter of which corresponding to or slightly exceeding the diameter of the coupling studs 3.

Coupling of the toy building element 1 according to the invention with the rigid toy building element 5 produces a coupling force between the two toy building elements since the elasticity of the through-going band 4 makes the outermost coupling studs 3 of the toy building element 1 press against the inside of the tubular members 7 as indicated by the arrows F.

Hereby a coupling force is produced between two toy building elements 1,5 in a stacking system, where there would not exist any coupling force between said coupling elements 1,5 in normal conditions.

The underside of the toy building element 1 may also be provided with coupling means in the form of tubular members, like the toy building element 5.

FIG. 3 illustrates an alternative toy building element 8 according to the invention, said toy building element constituting in itself a toy.

The toy building element 8 is in the shape of a looper with a head 9 and a tail 10 and wheels 11. The central elements 12 which corresponds to the constituents 2 in FIG. 1 have coupling studs 13 for interconnecting the toy building element 8 with other toy building elements 5.

The three central elements 12 are connected to each other and to the head and tail of the toy building element 8 by means of a through-going elastic band 14 in the same manner as in the toy building element 1 shown in FIG. 1. The design of this through-going band 14 will appear more clearly from FIG. 3.

Thus, interconnecting with other toy building elements 5 enables the toy building element 8 to assume a straight configuration (not shown) corresponding to the configuration of the toy building element 1 shown in FIG. 2 while simultaneously producing a coupling force between the toy building element 8 and the toy building element 5.

In the embodiments shown, the toy building element 1,8 is illustrated as comprising constituents 2,12 which are connected to each other by a through-going elastic band 4,14. The constituents 2,12 may, however, be connected to each other in other ways, e.g. by means of integral hinges in those regions where the constituents 2,12 abut on each other.

It is not necessary for the toy building element 1,8 to assume an arcuate configuration in its free state illustrated in FIGS. 1 and 3 as long as it is ensured that the coupling means have departed from the modular distance.

Thus the constituents 2,12 may be connected by an elastic bellows portion or some other kind of elastic connection between the individual constituents 2,12, said connection causing the constituents 2,12 to be aligned but still departing from the modular distance. Hereby it is possible to obtain the same function as obtained with the arcuate configuration of the toy building element 1,8.

In addition to a flexing of the coupling means out of the plane (as illustrated in FIGS. 1 and 3) and a shifting of the coupling means in the plane to a position out of (or within) the modular distance as described above, longitudinal twisting of the toy building element 1,12 will bring about the same function.

As mentioned above, the invention is particularly directed to toy building elements 1, 5 and 8 in a stacking system where, in normal conditions, no coupling force exists between the individual toy building elements 1, 5 and 8, and where it is possible with the toy building element 1,8 according to the invention to produce a coupling force between said toy building elements 1, 5 and 8.

However, nothing prevents the invention from being used with other toy building systems with coupling force between the individual toy building elements, since in that event such toy building element 1,8 according to the invention will produce an increased coupling force.

We claim:

1. A toy building element for use in a toy building element system comprising a number of toy building elements, said toy building element comprising:

at least two constituents with coupling means, said constituents being connected to each other in a flexible manner by means of a through-going flexible rod which is preshaped to an arcuate configuration, coupling means for coupling with other toy building elements having complementary coupling means being arranged in a regular pattern with a specific modular distance relative to each other, wherein at least some of the coupling means of the toy building element in the free state thereof are shifted relative to said modular distance, the mutual position of the coupling means of the toy building element being elastically changeable at least to a mutual position corresponding to said modular distance.

2. A toy building element according to claim 1, wherein the constituents are made in one piece with a reduced material thickness between the constituents.

3. A toy building element according to claim 1, wherein the coupling means consist of coupling studs arranged on the upper surface of the toy building element.

4. A toy building element according to claim 3, wherein exactly one coupling stud is provided on each constituent.

5. A toy building element according to claim 3, wherein sockets are also provided on the underside of the toy building element, said sockets being complementary to the coupling studs on the upper surface.

6. A toy building set comprising a number of rigid toy building elements with coupling means for coupling with other rigid toy building elements with corresponding coupling means, said coupling means being arranged in a regular pattern with a specific modular distance relative to each other, wherein the toy building set also comprises at least one flexible toy building element with coupling means, wherein at least some of the coupling means in the free state of the toy building element are shifted relative to said modular distance, the mutual position of the coupling means of the flexible toy building element being elastically changeable at least to a mutual position corresponding to said modular distance.

7. A toy building set according to claim 6, wherein the shifted coupling means on the flexible toy building element are caused to occupy a position corresponding to said modular distance when the flexible toy building element is interconnected with one of the rigid toy building elements.

8. A toy building set according to claim 6, wherein the coupling means on the rigid toy building elements are constituted of coupling studs arranged on the upper surface of the toy building elements and complementary sockets on the underside of the toy building elements and that the coupling means on the flexible toy building element consist at least of coupling studs on the upper surface of the flexible toy building element.

9. A toy building set according to claim 8, wherein the flexible toy building element comprises at least to constituents with coupling studs said constituents being connected to each other in a flexible manner.

10. A toy building set according to claim 9, wherein exactly one coupling stud is provided on each constituent and that the toy building elements couple loosely on exactly one coupling stud.

11. A toy building set according to claim 8, wherein sockets are also provided on the underside of the flexible toy building element said sockets being complementary to the coupling studs provided on the upper surface.

* * * * *